US007004050B2

(12) United States Patent
Wong

(10) Patent No.: US 7,004,050 B2
(45) Date of Patent: Feb. 28, 2006

(54) CORK EXTRACTOR

(76) Inventor: Chung Lun Wong, Flat G, 42/F., Block 8, Island Harbourview, 11 Hoi Fai Road, Kowloon (HK)

( * ) Notice: Subject to any disclaimer, the term of this patent is extended or adjusted under 35 U.S.C. 154(b) by 127 days.

(21) Appl. No.: 10/796,433

(22) Filed: Mar. 9, 2004

(65) Prior Publication Data

US 2004/0194581 A1 Oct. 7, 2004

(30) Foreign Application Priority Data

Apr. 1, 2003 (CN) ..... 03114087
Apr. 1, 2003 (CN) ..... 03224718

(51) Int. Cl.
*B67B 7/04* (2006.01)

(52) U.S. Cl. ..... 81/3.47; 81/3.36; 81/3.45

(58) Field of Classification Search ..... 81/3.47, 81/3.45, 3.36, 3.29, 3.39, 3.55, 3.09, 3.25, 81/3.2
See application file for complete search history.

(56) References Cited

U.S. PATENT DOCUMENTS 5,018,409 A * 5/1991 Bittel ..... 81/3.55
5,454,282 A * 10/1995 Del Mistro ..... 81/3.48
5,799,551 A * 9/1998 Vitrac ..... 81/3.09
6,016,721 A * 1/2000 Braun ..... 81/3.29

FOREIGN PATENT DOCUMENTS

DE 42 05 426 A1 1/1993
GB 2 216 884 A 10/1989

* cited by examiner

*Primary Examiner*—Lee D. Wilson
*Assistant Examiner*—Alvin J. Grant
(74) *Attorney, Agent, or Firm*—Alix, Yale & Ristas, LLP

(57) ABSTRACT

A cork extractor includes a body having a pair of opposed side walls defining a gap therebetween and having a dimension that radially increases from a first end to a second end of the body. A hinge member is rotatably fixed at the first body end for turning about an axis, and a corkscrew is connected to the hinge member. The corkscrew is pivotable about the axis between a retracted position lying in the gap and an extended position for pulling a cork out from a bottle mouth upon the body being turned about the hinge member while bearing slidingly against the bottle mouth at a position sliding from its first end to its second end.

11 Claims, 3 Drawing Sheets

CORK EXTRACTOR

BACKGROUND OF THE INVENTION

This invention relates generally to cork extractors. More particularly, the present invention relates to cork extractors for pulling corks and stoppers from bottle necks and other apertures.

A typical cork extractor comprises a screw member connected to a handle which enables the tip of the screw to be twisted into a cork and the cork to be pulled. However, because the cork extractor must be pulled directly outwards from the orifice in which the cork is retained, there is no leverage to assist extraction. Consequently, whilst still widely used, these corkscrews cannot be regarded as satisfactory.

Cork extractors are known to have an eccentric body for turning against the mouth of a bottle for pulling a cork out therefrom through a cam action, for example as disclosed in Great Britain Patent Publication No. 2 216 884 A and German Publication No. 42 05 426 A1. The cork extractor of Great Britain Patent Publication No. 2 216 884 A has a relatively complicate or bulk construction, whereas the operation of the other one of German Publication No. 42 05 426 A1 is not convenient or reliable.

SUMMARY OF THE INVENTION

According to the invention, there is provided a cork extractor which comprises a body having a pair of opposed parts defining a gap therebetween and having a dimension that radially increases from a first end to a second end of the body. A hinge member is rotatably fixed at the first body end for turning about an axis fixed with respect to the body, and a corkscrew is connected to the hinge member. The corkscrew is pivotable about the axis between a retracted position lying in the gap and an extended position for pulling a cork out from a bottle mouth upon the body being turned about the hinge member while bearing slidingly against said bottle mouth at a position sliding from its first end to its second end.

Preferably, the hinge member includes a surface from which the corkscrew projects, the surface extends at right angles to the axis for bearing stably against a cork while it is being pulled out by the corkscrew.

More preferably, the hinge member surface occupies substantially the entire width of the gap.

In a specific construction, the hinge member has a relatively short generally part-cylindrical shape centering at the axis.

In a specific construction, the two body parts comprise a pair of opposed walls having respective aligned spirally curved edges for bearing against said bottle mouth.

It is preferred that the hinge member includes a protrusion from one end of the surface, and the body has a generally L-shaped opening generally matching and aligned with the hinge member surface and protrusion when the corkscrew is in the extended position.

It is preferred that the hinge member includes a protrusion from one end of the surface, which abuts a part of the body to define the extended position of the corkscrew.

Advantageously, the two body parts include respective opposed inclined surfaces to facilitate entry of said cork into the gap upon being pulled by the corkscrew out from said bottle mouth.

Preferably, the two body parts are inter-connected by a web together having a generally U-shaped cross-section, and the corkscrew lies in its retracted position adjacent the web.

In a preferred embodiment, the two body parts are inter-connected by a web which has an end provided with a cutter for cutting a sealing foil on said cork and bottle mouth.

More preferably, the web end protrudes slightly from the second body end, and the cutter is located close to and within the web end.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
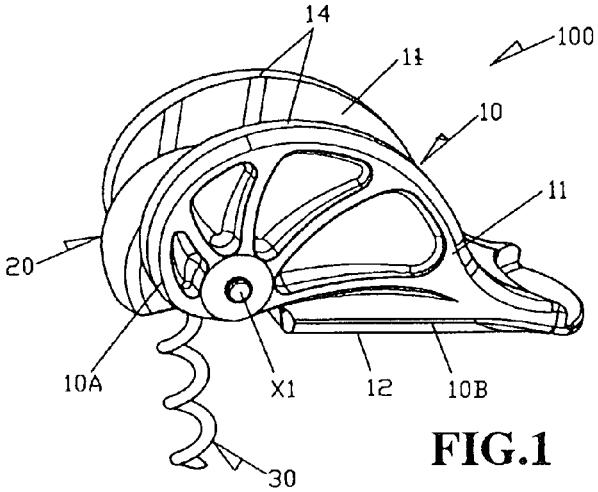
FIG. 1 is a perspective side view of an embodiment of a cork extractor in accordance with the invention.
Figure 4:
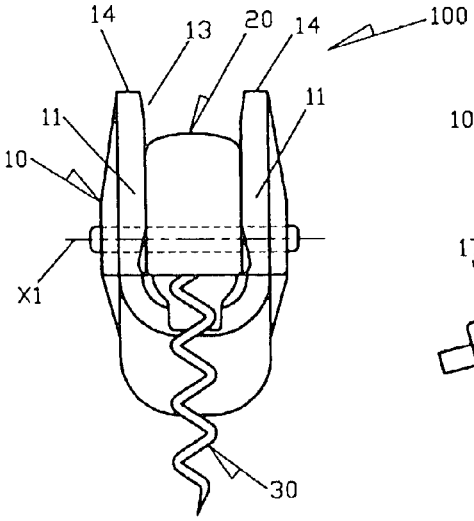
FIG. 4 is a front end view of the cork extractor of FIG. 2.

Referring to the drawings, there is shown a cork extractor 100 embodying the invention, which extractor 100 has a body 10 formed by a pair of opposed left and right side walls 11 that are integrally inter-connected by a lower web 12 together having a generally U-shaped cross-section, in the position as shown. The two side walls 11 are generally planar and identical in shape albeit being mirror images of each other, defining a gap 13 therebetween. They have respective spirally curved edges 14 in mutual alignment such that the overall extractor body 10 has a dimension that radially increases from a front end 10A to a rear end 10B of the body 10 with respect to a horizontal lateral axis X1, resulting in an eccentric shape.

The web 12 extends from the extremity of the rear body end 10B and reaches short of the front body end 10A including the axis X1, where the two side walls 11 overhang from above the web 12 to form an L-shaped front bottom opening 15. At the rear body end 10B and at a short distance within its extremity, the web 12 includes on its inner surface a raised integral step 16 that is fitted with a pair of small fixed or rotary foil cutters 17 close to the web surface. While the cutters 17 point outwards for cutting, they stay within or behind the rearmost end of the web 12 for safety, and the rearmost end protrudes slightly from the rear body end 10B.

A relatively short generally part-cylindrical hinge member 20 centering at the axis X1, is rotatably fixed at the front body end 10A, adjacent the L-shaped opening 15, for free turning about the axis X1. The hinge member 20 has a horizontal oblong flat surface 21 below its centre as shown, to which a corkscrew 30 is secured and projects downwards. The surface 21, which occupies the entire width of the gap 13, extends at right angles to the axis X1 and, as shown, turns at one end smoothly downwards such that there is an integral rear protrusion 22 from the surface 21, together generally matching and aligned with the L-shaped opening 15 when the corkscrew 30 is in the extended position.

Figure 2:
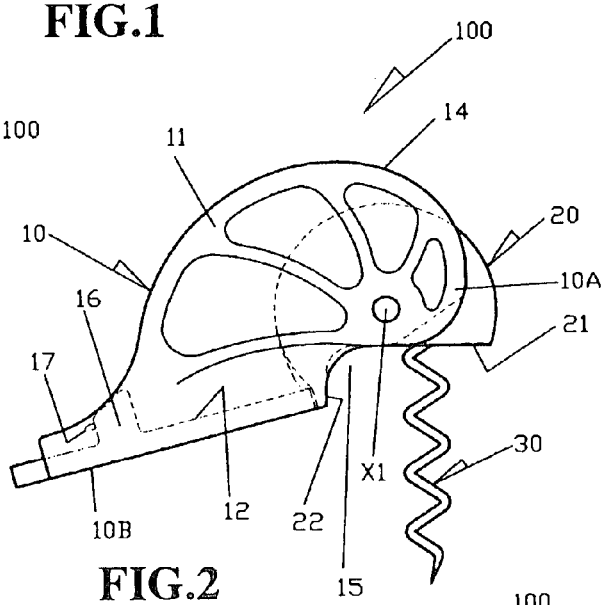
FIG. 2 is an opposite elevational side view of the cork extractor of FIG. 1.
Figure 3:
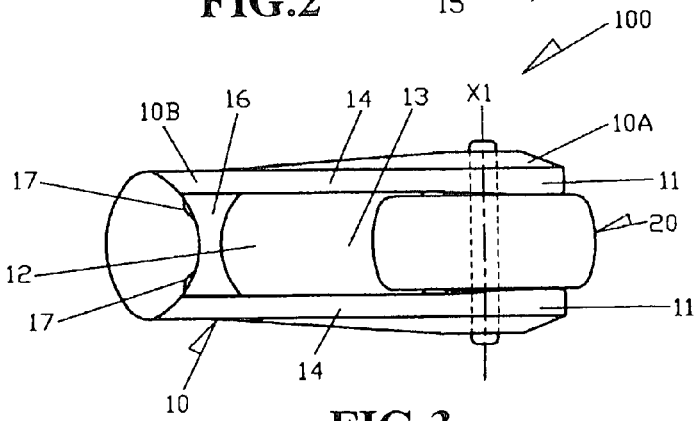
FIG. 3 is a top plan view of the cork extractor of FIG. 2.
Figure 8:
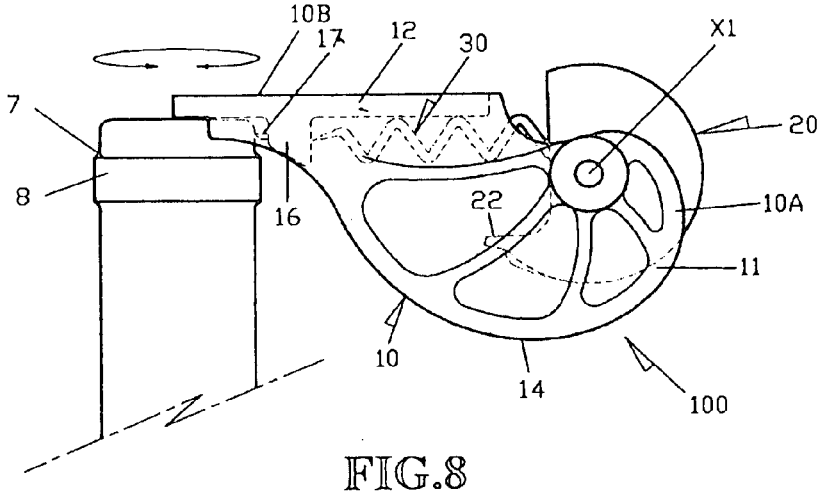
FIG. 8 is an elevational side view illustrating how the cork extractor of FIGS. 5 to 7 initially cuts open a tin foil on the cork.

The corkscrew 30 is pivotable with the hinge member 20 about the axis X1 between an extended position (FIGS. 2 and 5) from the extractor body 10 for extracting a cork 9 out from a bottle mouth 8 and a retracted position (FIG. 8) lying wholly within the gap 13 on or adjacent the inner surface of the web 12. The extended position is defined by the hinge member protrusion 22 abutting the front end of the web 12 (FIGS. 2 and 5), whereas the retracted position by the corkscrew 30 reaching the web 12 (FIG. 8).

Figure 5:
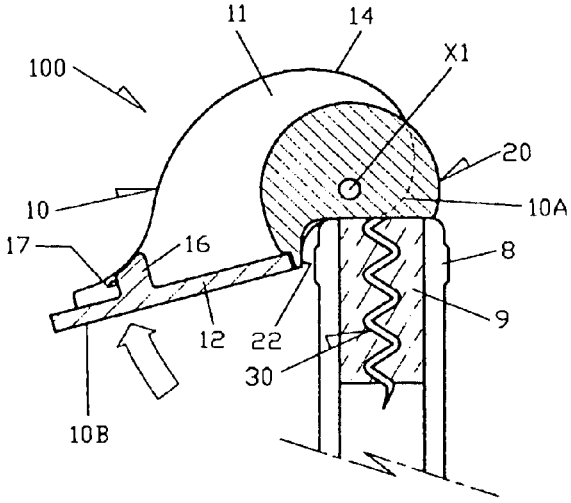
FIGS. 5 to 7 are sequential cross-sectional side views illustrating how the cork extractor of FIG. 2 extracts a cork from a bottle mouth.
Figure 6:
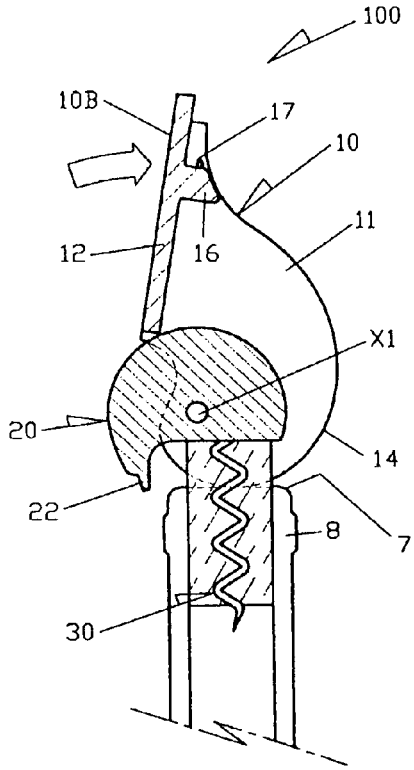
Figure 9:
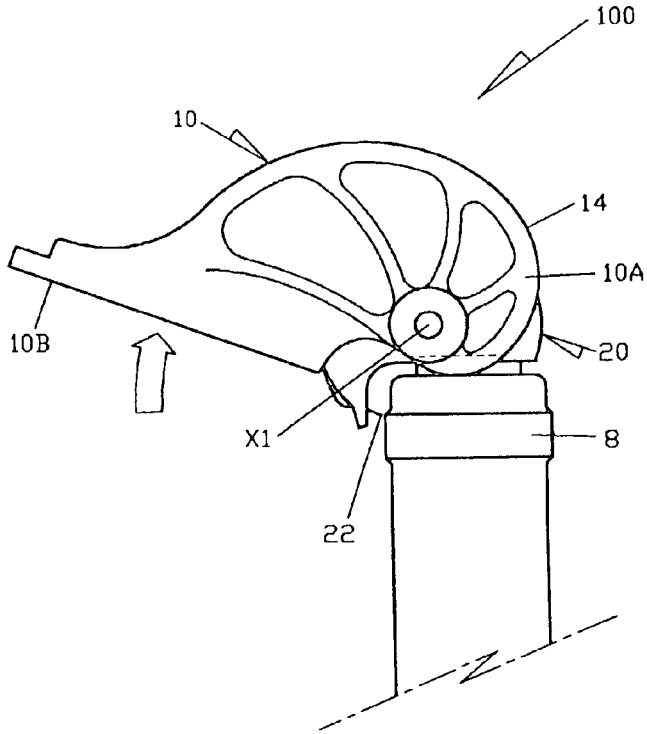

The operation of the cork extractor 100 is now described. While in the extended position, the corkscrew 30 is screwed down into the cork 9 by turning the extractor body 10 until the flat surface 21 of the hinge member 20 abuts the upper end of the cork 9 (FIG. 5). The body 10 is then turned slowly upwards by its rear end 10B about the hinge member 20, with its edges 14 bearing slidingly against the bottle brim 7 on opposite sides of the cork 9 at a position sliding from the front body end 10A to the rear body end 10B. This results in the cork 9 being gradually pulled out of the bottle mouth 8 into the body 10 as the hinge member 20 is lifted by the body walls 11 acting upon the brim 7 through a cam action (FIGS. 6 and 9).

Figure 7:
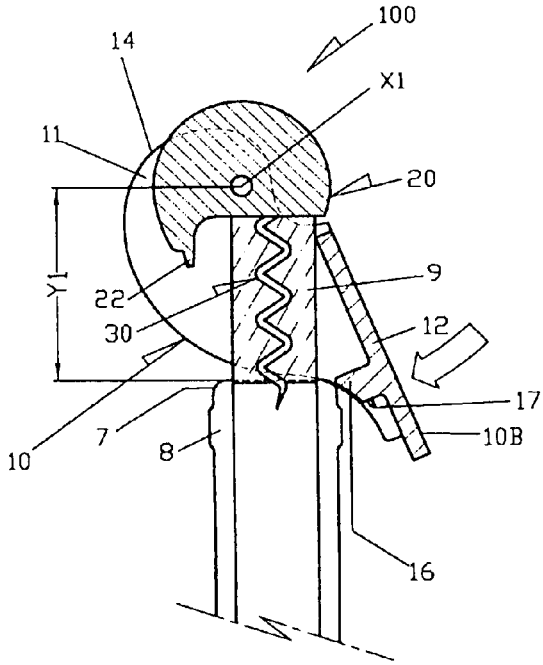
Figure 10:
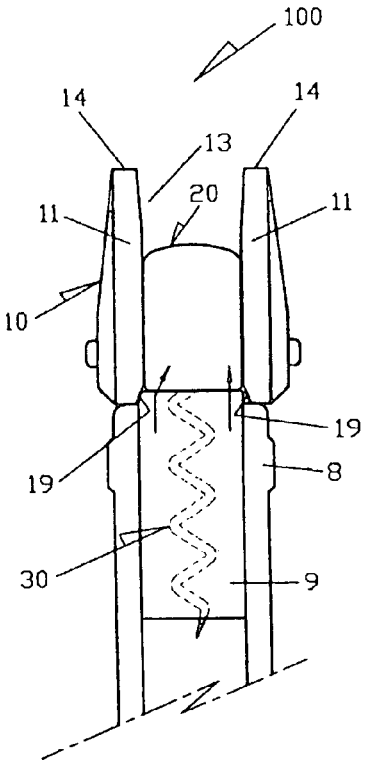
FIGS. 9 and 10 are side and front end views of the cork extractor, corresponding to FIG. 5, illustrating how the cork is guided to initially enter into the body of the extractor upon extraction.

At the bottom, the inner surfaces of the extractor body walls 11 are inclined or chamfered at 19 to facilitate or guide the cork 9 to initially enter into the gap 13 of the extractor body 10 upon extraction (FIG. 10). The hinge member surface 21 is sufficiently long to cover the entire upper end of the cork 9 such that it bears stably against the cork 9 while the latter is being pulled out. The radial dimension (Y1) of the body walls 11 is sufficiently larger such that upon the rear body end 10B flipping, over and down to the opposite side, the cork 9 is completely unplugged (FIG. 7).

The cork 9 and bottle mouth 8 are originally sealed or wrapped by a tin foil, which should first be cut open before the cork 9 can be extracted. This can conveniently be done by using the built-in foil cutters 17. To do this, while the extractor 100 is turned upside-down preferably with the corkscrew 30 retracted, the rearmost end of the web 12 is pressed against the upper end of the cork 9 such that the cutters 17 pierce through the sealing foil. The bottle mouth 8 is then turned while being pressed against the cutters 17, whereby the foil is split as between the cork 9 and the bottle mouth 8.

The invention has been given by way of example only, and various modifications of and/or alterations to the described embodiment may be made by persons skilled in the art without departing from the scope of the invention as specified in the appended claims.

What is claimed is:

1. A cork extractor comprising:

a body having a pair of opposed body members defining a gap therebetween and having a dimension that radially increases from a first end to a second end of the body;

a hinge member rotatably fixed at the first body end for turning about an axis fixed with respect to the body; and a corkscrew connected to the hinge member for pivotal movement about the axis between a retracted position lying in the gap and an extended position for pulling a cork out from a bottle mouth upon the body being turned about the hinge member while bearing slidingly against said bottle mouth at a position sliding from its first end to its second end.

2. The cork extractor as claimed in claim 1, wherein the hinge member includes a surface from which the corkscrew projects, the surface extends at right angles to the axis for bearing stably against a cork while it is being pulled out by the corkscrew.

3. The cork extractor as claimed in claim 2, wherein the hinge member surface occupies substantially the entire width of the gap.

4. The cork extractor as claimed in claim 1, wherein the hinge member has a part-cylindrical shape centering at the axis.

5. The cork extractor as claimed in claim 1, wherein the two body members comprise a pair of opposed walls having respective aligned spirally curved edges for bearing against said bottle mouth.

6. The cork extractor as claimed in claim 2, wherein the hinge member includes a protrusion from a one end of the surface, and the body has a generally L-shaped opening generally matching and aligned with the hinge member surface and protrusion when the corkscrew is in the extended position.

7. The cork extractor as claimed in claim 2, wherein the hinge member includes a protrusion from a one end of the surface, which abuts a portion of the body to define the extended position of the corkscrew.

8. The cork extractor as claimed in claim 1, wherein the two body members include respective opposed inclined surfaces to facilitate entry of said cork into the gap upon being pulled by the corkscrew out from said bottle mouth.

9. The cork extractor as claimed in claim 1, wherein the two body members are inter-connected by a web, the body members and web, defining a substantially U-shaped cross-section, the corkscrew being disposed adjacent the web in the retracted position.

10. The cork extractor as claimed in claim 1, wherein the two body members are inter-connected by a web which has an end provided with a cutter for cutting a sealing foil on said cork and bottle mouth.

11. The cork extractor as claimed in claim 10, wherein the web end protrudes from the second body end, and the cutter is located within the web end.

* * * * *